US006358097B1

(12) United States Patent
Peters

(10) Patent No.: US 6,358,097 B1
(45) Date of Patent: Mar. 19, 2002

(54) CONTACT ELEMENT, PROCESS FOR MAKING THE SAME AND CONNECTOR COMPRISING THE SAME

(75) Inventor: Martinus Johannes Maria Peters, Zealand (NL)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/620,689

(22) Filed: Jul. 20, 2000

(30) Foreign Application Priority Data

Jul. 23, 1999 (NL) ..... 1012695

(51) Int. Cl.[7] ..... H01R 13/24
(52) U.S. Cl. ..... 439/700; 439/885
(58) Field of Search ..... 439/700, 482, 439/824, 844, 885–886, 289, 219, 220, 816; 29/882; 324/754, 761

(56) References Cited

U.S. PATENT DOCUMENTS 4,466,689 A * 8/1984 Davis et al. ..... 29/882
4,531,803 A 7/1985 Hughes ..... 439/391
4,773,877 A 9/1988 Kruger et al. ..... 439/482
4,778,404 A * 10/1988 Pass ..... 439/387
5,667,410 A 9/1997 Johnston ..... 439/700
5,807,123 A 9/1998 Spiegelaar et al. ..... 439/188
5,879,205 A * 3/1999 Egenolf et al. ..... 439/844
5,967,856 A * 10/1999 Meller ..... 439/700
6,083,059 A * 7/2000 Kuan ..... 439/700 X

FOREIGN PATENT DOCUMENTS

DE 19525390 A1 2/1996
FR 2721442 12/1995

* cited by examiner

*Primary Examiner*—Brian Sircus
*Assistant Examiner*—Son V. Nguyen
(74) *Attorney, Agent, or Firm*—Perman & Green, LLP

(57) ABSTRACT

The invention pertains to a contact element, especially suitable for mobile applications, made of a electrically conductive material, preferably a metal, and comprising a first contact and a second contact which are connected to one another by means of a spring. The contact element further comprises at least one rigid element which is attached either to the first or to the second contact, which element bridges the spring and runs parallel to at least part of the other of the said contacts.

9 Claims, 2 Drawing Sheets

CONTACT ELEMENT, PROCESS FOR MAKING THE SAME AND CONNECTOR COMPRISING THE SAME

BACKGROUND OF THE INVENTION

The invention pertains to a contact element, especially suitable for mobile applications such as phones, made of an electrically conductive material, preferably a metal, and comprising a first contact or foot and a second contact or plunger member which are connected to one another by means of a spring.

Such contact elements are known, e.g. from U.S. Pat. No. 4,773,877. This U.S. patent discloses a contactor for an electronic tester for testing an electronic device such as a printed circuit board or the like, which has at least one resilient contact pin that is electrically conducting and engageable with a contact or terminal of said electronic device. Each of said resilient contact pins has a plunger member whose plunger head is guided linearly in a slot, said plunger member being followed in the axial direction by a spring. Said plunger member and said spring of the resilient contact pins according to U.S. Pat. No. 4,773,877 are jointly formed in one piece from a portion of a metal sheet. In a preferred embodiment the resilient contact pin is equipped with a linear slider guide in which said plunger head is axially slideable and in which said spring is located and said resilient contact pin consists of said slider guide and said bar. The slider guide may also be made of the said metal sheet.

In other words, each of the contact pins according to U.S. Pat. No. 4,773,877 comprises a separate holding and guiding box. The contact pin must be inserted into this box before the combination of contact pin and box is inserted in a cavity in the housing of a contactor, which procedure thus is rather labour intensive.

Also, use of such a box does not allow maximum miniaturisation.

SUMMARY OF THE INVENTION

The invention aims to provide a contact element of the above-mentioned type which allows easy manufacture, does not involve the use of a voluminous holding and guiding box, and allows easy and fast insertion of the contact element directly into the housing of, e.g., a connector or contactor.

To this end, the invention is characterised in that at least one, preferably substantially flat, rigid element is attached either to the first or to the second contact, which element bridges the spring and runs parallel to at least part of the other of the said contacts.

Such a rigid element facilitates insertion of the contact element into a housing and obviates the need for a separate holding and guiding box.

In a preferred embodiment the first and second contacts, the spring, and the rigid element are jointly formed in one piece from a sheet of an electrically conductive material, preferably a metal. It is further preferred that after formation of the said one piece, the connection between the rigid element and the rest of the contact element is subsequently bent over an angle of approximately 180°.

Thus, the contact element including the rigid element can be formed, e.g., from a metal sheet in one go. After the said forming of the contact element, the main process steps remaining are bending of the rigid element and cutting the obtained contact element loose from its carrier.

BRIEF DESCRIPTION OF THE DRAWINGS

The invention will be further explained by reference to the drawings in which various embodiment of the contact element according to the present invention are schematically shown.

DETAILED DESCRIPTION OF THE INVENTION

Figure 1:
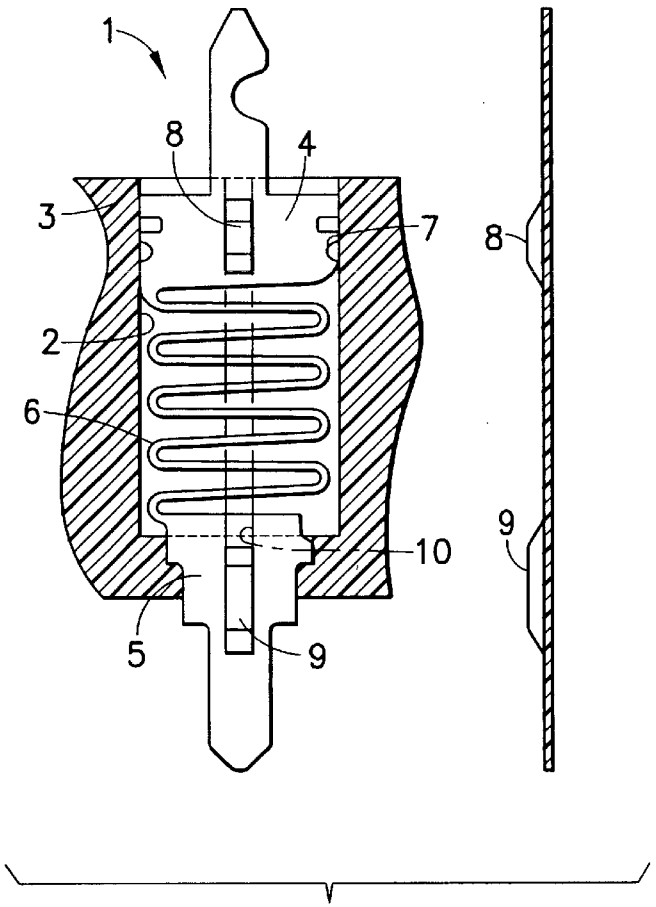
FIG.1 PRIOR ART
FIG. 1 shows a cross-section of a plastic housing comprising a contact element according to the prior art.

FIG. 1 shows a contact element 1 according to the prior art after it has been inserted into a cavity 2 of a plastic housing 3. The contact element 1 comprises a foot or first contact 4, a plunger member or second contact 5 and a spring 6 which connects the first contact 4 to the second contact 5. The contact element 1 is retained in the cavity 2 of the housing 3 by means of protrusions or barbs used as retaining means 7 located on the outer edges of the first contact 4.

The first contact 4 and the second contact 5 are respectively provided with a first protrusion or lanced portion 8 and a second protrusion or lanced portion 9. These lanced portions 8, 9 co-operate with a guide groove 10 in the cavity 2, which extends over the entire thickness of the housing 3 in the longitudinal direction of the cavity 2. Although the resilient behaviour of the contact element is essential to its function in the eventual contactor, it obstructs the insertion of the contact element into the cavity 2.

Figure 2:
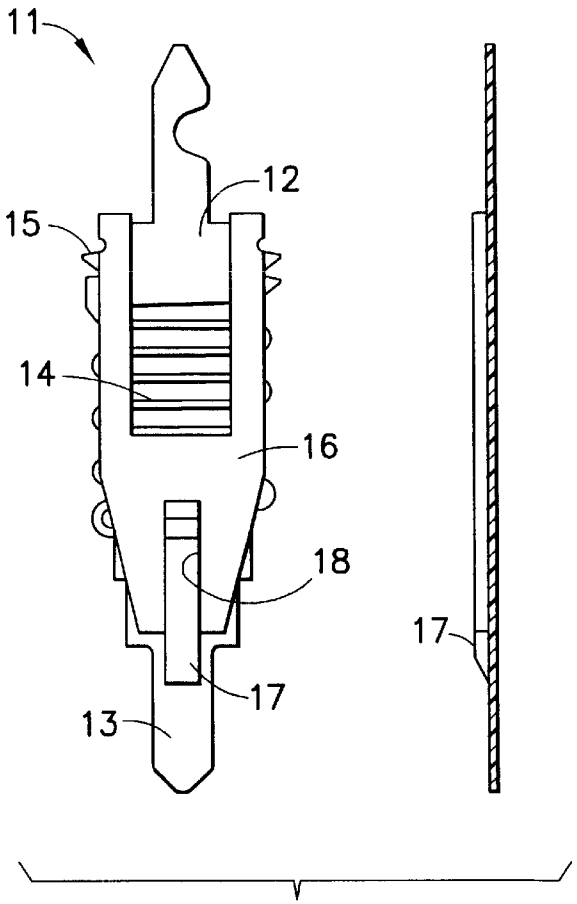
FIG. 2 shows a front elevation of a contact element in accordance with an embodiment according to the present invention.

FIG. 2 shows an embodiment of a contact element 11 in accordance with the present invention. Contact element 11 also comprises a foot or first contact 12, a plunger member or second contact 13, a spring 14 which connects the first contact 12 to the second contact 13, and protrusions or barbs used as retaining means 15 for retaining the contact element 11 in a cavity of the housing of a connector or the like.

Contact element 11 is further provided with a substantially flat or plate-like rigid element 16. Rigid element 16 is attached to the first contact 12 and runs parallel to the greater part of contact element 11, thus bridging the spring 14 and running parallel to the part of the second contact 13 nearest the spring 14. The rigid element 16 provides sufficient stiffness and rigidity to the entire contact element 11 to enable fast insertion into a cavity in the housing of a connector or the like. The design shows in FIG. 1 (prior art) allows an insertion speed of 120 contact elements per minute, whereas the design shown in FIG. 2 according to the invention allows an insertion speed of up to 600 contact elements per minute.

The contact element 11 according to the present invention preferably comprises a protrusion or lanced portion 17 on its second contact 13, whereas the rigid element 16 comprises an elongated recess or slot 18 in the longitudinal direction of the contact element 11 for guiding the said protrusion 17. Thus, there is no need to provide a guiding slot or groove in the cavity of the housing in which the contact element 11 is to be fitted.

In the above embodiments, the first and second contacts, the spring, and the rigid element are preferably jointly formed in one piece from a sheet of an electrically conductive material, preferably a metal.

It is further preferred that after formation of the said one piece, the connection between the rigid element and the rest of the contact element is subsequently bent over an angle of approximately 180°.

FIGS. 3 to 6 show respectively an embodiment according to the prior art and three different embodiments according to the present invention, which are all still attached to their respective carriers 19.

Figure 4:
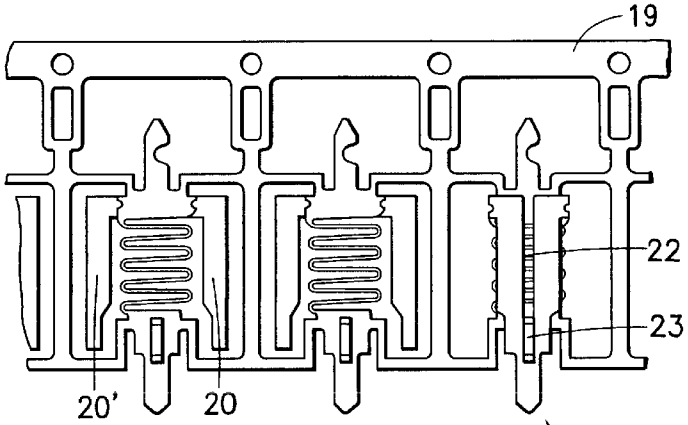
FIGS. 4 to 6 show a front elevation of three different embodiments according to the present invention, also still attached to their respective carriers.

FIG. 4 shows an embodiment comprising two rigid elements 20 and 20', located on either side of the rest of the contact element 21. When the rigid elements 20 and 20' are both folded over an angle of 180 degrees, they inherently form a longitudinal slot 22 for guiding a protrusion 23 on the contact element 21.

Figure 5:
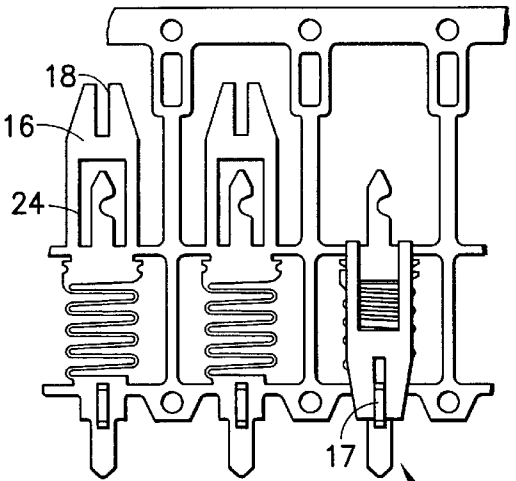

FIG. 5 shows the contact element 11 according to FIG. 2 discussed above, wherein the rigid element 16 is connected to the rest of the contact element 11 by means of two arms 24. Also, the rigid element 16 is provided with a longitudinal slot 18, which, after the rigid element 16 has been folded over an angle of 180 degrees, serves to guide the protrusion 17 on the contact element 11.

Figure 6:
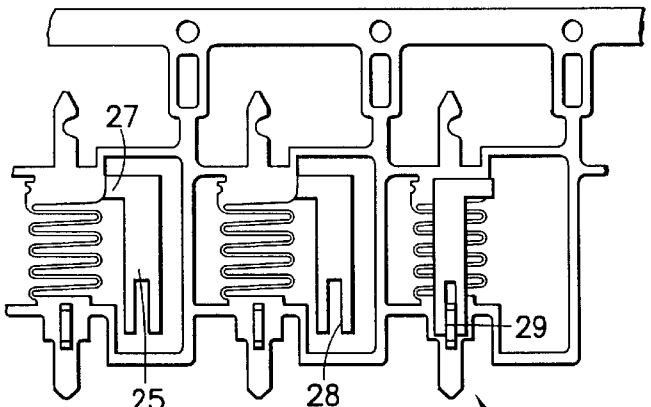
Figure 3:
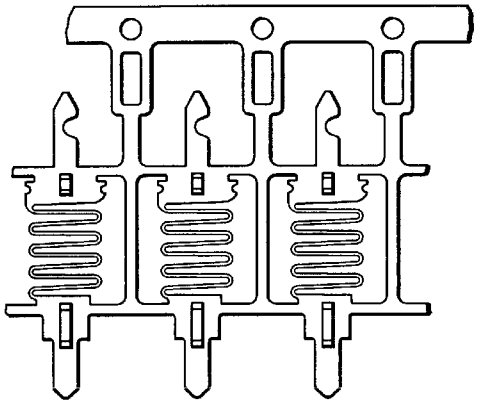
FIG.3 PRIOR ART
FIG. 3 shows a front elevation of a contact element according to the prior art while it is still attached to its carrier, i.e. just after it has been punched from a metal sheet.

FIG. 6 shows yet a third embodiment according to the invention. This embodiment comprises a single rigid element 25, which is attached to the rest of the contact element 26 by means of a single arm 27. The rigid element 25 is provided with a longitudinal slot 28, which, after the rigid element 25 has been folded over an angle of 180 degrees, serves to guide a protrusion 29 on the contact element 26. This last version makes very economical use of the metal sheet material from which it is manufactured.

After its punching or stamping, edging or the like, the contact element can be deburred and provided with at least one chemically or galvanically, e.g. a nickel coating, gold coating or the like. One or more of such coatings can already be provided on the metal sheet before punching or edging. The thickness of the metal sheet from which the contact element is made can be vary small, e.g. in the range from 0.05 mm to 1.5 mm, preferably in the range from 0.15 to 0.4 mm, for example 0.2 to 0.3 mm.

Since the contact element according to the present invention comprises a spring, the metal should have resilient elastic properties. For this purpose the metal sheet preferably contains or consists essentially of steel, copper-beryllium, or nickel-beryllium.

The resilient contact element according to the present invention can be used in a variety of applications especially mobile applications such as mobile phones, which depend on the extremely small central and lateral spacing between neighbouring resilient contact elements and where conventional contact elements can not be used. It can allow an extremely small grid size.

The present invention also relates to a process for making the contact element as described above and a connector or contactor comprising the same.

The invention is not restricted to the above described embodiments which can be varied in a number of ways within the scope of the claims.

What is claimed is:

1. A contact element, made of an electrically conductive material and comprising a first contact and a second contact which are connected to one another by means of a spring, and at least one flat conductive rigid element integrally attached to one of the first and second contacts, the rigid element bridging the spring and running parallel to at least part of the other of the first and second contacts which is not attached to the rigid element and wherein the other of the first and second contacts is arranged to slide with respect to the rigid element.

2. The contact element according to claim 1, wherein the first and second contacts, the spring, and the rigid element have been jointly formed in one piece from a portion of a sheet of the electrically conductive material.

3. The contact element according to claim 2, wherein, the rigid element has been bent over an angle of approximately 180 degrees relative to the first and second contacts and the spring.

4. The contact element according to claim 2, wherein the conductive material is a metal sheet.

5. The contact element according to claim 4, wherein the metal sheet is comprised of steel, copper-beryllium, or nickel-beryllium.

6. The contact element according to claim 1, wherein the other contact that can slide with respect to the rigid element is provided with a protrusion and the rigid element comprises an elongated edge, recess or slot extending in a longitudinal direction of the contact element for guiding the protrusion and the other contact that can slide.

7. The contact element according to claim 1, which comprises a connector or a contactor.

8. Process for making a contact element made of an electrically conductive material, the contact element comprising a first contact and a second contact which are connected to one another by means of a spring, and at least one flat conductive rigid element integrally attached to one of the first and second contacts, the rigid element bridging the spring and running parallel to at least part of the other of the first and second contacts which is not attached to the rigid element and wherein the other of the first and second contacts is arranged to slide with respect to the rigid element, said process comprising: jointly forming in one piece from a portion of a sheet of the electrically conductive material at least two contact elements, comprising the first and second contacts, the spring, and at least one rigid element, and a carrier connecting the contact elements, the spring and the at least one rigid element.

9. The process according to claim 8, wherein, after formation of the said one piece and prior to removal of the contact elements from the carrier, the rigid element is bent over an angle of approximately 180 degrees relative to the first and second contacts and the spring.

* * * * *